US005541028A

United States Patent [19]

Lee et al.

[11] Patent Number: 5,541,028

[45] Date of Patent: Jul. 30, 1996

[54] CONSTRUCTING TONE SCALE CURVES

[75] Inventors: Hsien-Che Lee, Penfield; Scott J. Daly, Scottsville; Richard L. VanMetter, Webster; Allen K. Tsaur, Rochester, all of N.Y.

[73] Assignee: Eastman Kodak Company, Rochester, N.Y.

[21] Appl. No.: 382,715

[22] Filed: Feb. 2, 1995

[51] Int. Cl.[6] ..... G03C 5/00

[52] U.S. Cl. ..... 430/30; 430/139; 430/502; 358/445; 382/132

[58] Field of Search ..... 430/30, 139, 502, 430/967; 358/445; 378/62; 382/6; 364/413.02

[56] References Cited

U.S. PATENT DOCUMENTS

| | | | |
|---|---|---|---|
| 4,455,292 | 6/1984 | Bertoni | 424/5 |
| 4,483,916 | 11/1984 | Thiers | 430/236 |
| 5,164,993 | 11/1992 | Capozzi et al. | 382/6 |
| 5,260,806 | 11/1993 | Samworth | 358/456 |
| 5,303,069 | 4/1994 | Speciner | 358/455 |
| 5,331,550 | 7/1994 | Stafford et al. | 364/413.02 |
| 5,361,139 | 11/1994 | Speciner | 358/445 |
| 5,371,537 | 12/1994 | Bohan et al. | 348/181 |
| 5,418,895 | 5/1995 | Lee | 395/131 |
| 5,426,684 | 6/1995 | Gaborski et al. | 378/62 |

*Primary Examiner*—S. Rosasco
*Attorney, Agent, or Firm*—Raymond L. Owens

[57] ABSTRACT

A method is disclosed for constructing a tone scale curve. In this curve, equal log exposure differences in an x-ray image of an object produce substantially equal brightness differences in a displayed image.

8 Claims, 8 Drawing Sheets

CONSTRUCTING TONE SCALE CURVES

FIELD OF INVENTION

This present invention relates to a method for producing visually optimized tone scale curves particularly suitable for diagnostic radiography. It also relates to films or film-screen combinations which provide such a curves.

BACKGROUND OF THE INVENTION

The tone scales used for diagnostic radiography have been based on sensitometric characteristic curves of silver halide films. These curves provide various contrasts and speeds for different examination types. However, the curve shapes have not been optimized for visual inspection of radiographic images. As a consequence, clinically important details are often obscured in the dark area of an x-ray image.

SUMMARY OF THE INVENTION

It is an object of the present invention to provide visually optimized tone scale curves.

Another object is to provide a method of designing tone scales such that details are equally visible, independent of the density of their surrounding areas.

Another object is to provide methods of controlling the contrast, the toe, and the shoulder of the visually optimized tone scale curves.

These objects are achieved by a method of constructing a tone scale curve so that equal log exposure differences in an x-ray image of an object produce substantially equal brightness differences in a displayed image so that objects of interest, such as tumors, can be better distinguished at all densities, comprising the steps of:

a) selecting a brightness versus log exposure relationship;

b) developing a luminance versus brightness curve based substantially on the equation $$B=\frac{L^n}{L^n+L_o^n}$$

where:

B is the perceived brightness;

n is in the range of $0.5<n<1.0$, preferably 0.7;

$L_o=12.6\times(0.2\times L_\omega)^{0.63}+1.083\times10^{-5}$;

L is the luminance in cd/m$^2$;

$L_\omega$ is the luminance of the minimum density area of the x-ray film; and c) selecting a density versus luminance curve and thereby producing the tone scale curve in which density is a function of log exposure, such that equal log exposure differences in an x-ray image of an object produce substantially equal brightness differences in the displayed image.

In order to ensure that physical features are equally visible through the entire gray scale, it is necessary to design the tone scale curve for the intended radiographic application so that equal log exposure differences are mapped into equal brightness differences on the display. Through psychophysical studies of x-ray image viewing, we have identified a number of brightness models that predict the perceived brightness difference better than other models. These brightness models permit calculating the required density on the film (or the luminance of a display) as a function of log exposure of the x-ray signals so that equal visibility of physical features can be achieved when the x-ray image is viewed by a radiologist. The invention also selects the speed, the contrast, the toe, and the shoulder of the tone scale curve so that it can be adapted to different needs for the various examination types in radiology. The entire family of the visually optimized tone scale curves is completely described by mathematical functions so that a curve can be customized and generated for each image. This flexibility is important in digital radiography because it permits a computer to render each image with optimal diagnostic quality.

Advantages

An advantage to the present invention is to provide the basis for optimized tone scales for radiographic images. These tone scales render equal brightness differences for similar objects regardless of the density caused by the surrounding tissues. This is substantial when compared with conventional screen-film tone scales which do not have this property. The tone scales can be customized to accommodate the latitude requirements of any particular radiographic examination while maintaining their optimization.

DETAILED DESCRIPTION OF THE PREFERRED EMBODIMENTS

Figure 1:
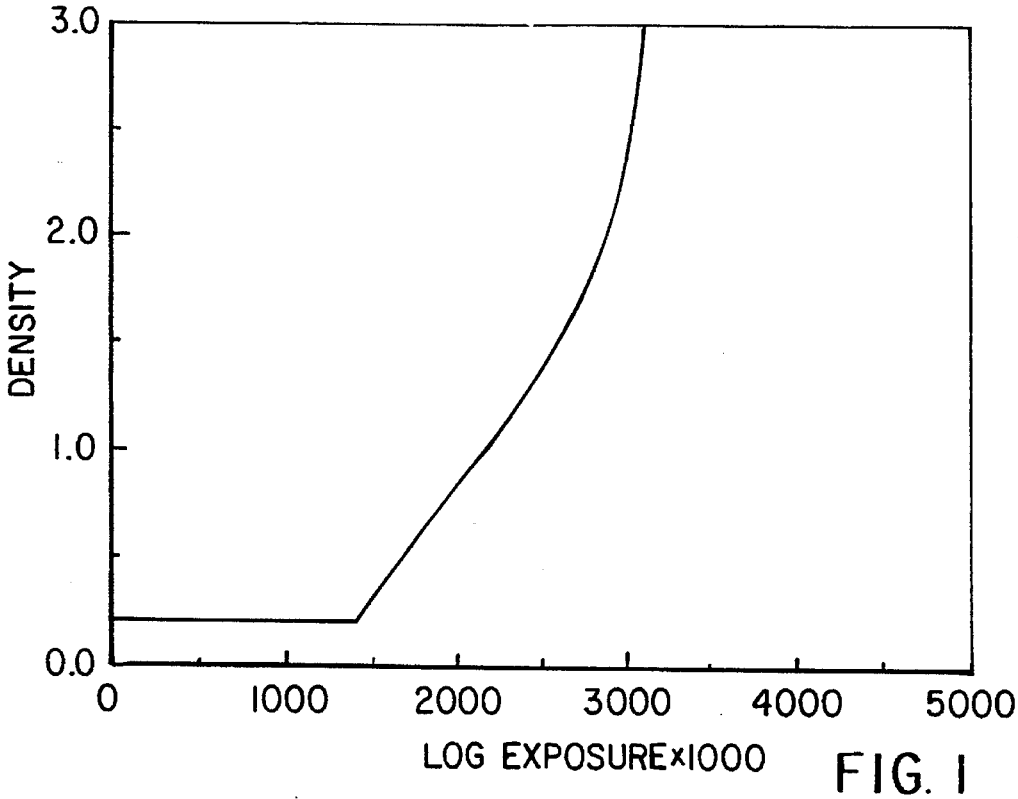
FIG. 1 is a tone scale curve (density versus log exposure) in accordance with the present invention.

The absorption and scattering of x-rays produces a shadow image of the internal structures of an object that is not visible to our eyes. The conversion of the invisible shadow image to a visible one requires a mathematical mapping from the invisible physical signal (x-ray fluence) to the visible image (display luminance). The mapping is called the radiographic tone scale. By convention, a tone scale curve is a curve which shows film density, D, as a function of log exposure, log E. Until very recently, the photographic films have been the dominant sensing (direct, or indirect from phosphor screen) and display media. The characteristic curves of the combined screen/film systems thus determine the tone scale mapping for diagnostic radiography. These curves provide various contrasts and speeds for different examination types. However, the curve shapes have not been optimized for visual inspection of radiographic images. As a consequence, clinically important details are often obscured in the dark area of an x-ray image.

A good tone scale for diagnostic radiography should produce equal perceived contrast for features having equal physical contrast, independent of the density of the surrounding area. To put it in a more quantifiable manner, the present invention optimizes a radiographic tone scale curve to produce an equal brightness difference for an equal log exposure difference detected by the x-ray sensing media, such as screen/film combinations or storage phosphors. The log exposure of these media reflects the x-ray transmittance through various body parts in diagnostic radiography.

What is needed is a good brightness model that describes the relationship between the physically measurable luminance and its perceived brightness under radiographic image viewing conditions. The modulation of the luminance signal of an x-ray film comes from the variation of the x-ray film density. Given a brightness model, one can calculate how much density variation is needed to produce a given brightness difference. From that knowledge, one can design a tone scale curve that will map the log exposure to the film density in such a way that when the film is placed in front of a viewbox, equal log exposure differences are reproduced as equal brightness differences. This invention discloses a means of designing such a visually optimized tone scale curve that can be used for developing a specific screen/film system that has the desired tone scale as its sensitometric characteristic curve.

Alternatively, one can use the tone scale in a digital radiographic system in which the x-ray image is exposed on a storage phosphor and read out by optoelectronic device and converted into digital signals. The digital image signal can be converted into numbers that represent log exposures on the storage phosphor through a calibration table or analog log amplifier. The desired tone scale can then be applied to the digital image to map it to the proper film density value that can be written onto a film by a digital printer. The tone scale curve can also be used in mapping the digital image to a video signal so that when the image is displayed on a CRT monitor, the displayed image produces equal brightness difference for equal log exposure difference.

Through our visual psychophysics experiments, we have identified three brightness models that describe the human brightness perception quite well under typical x-ray image viewing conditions, i.e., dark to dim surrounds and at a mean luminance level from 100 to 4000 cd/m$^2$. These three brightness models are as follows:

1. The Michaelis-Menten function $$B=\frac{L^n}{L^n+L_o^n} \tag{1}$$

where:

B is the perceived brightness;

L is the luminance of an image area in cd/m$^2$;

n is in the range of 0.5<n<1.0, preferably 0.7; and $L_o$ is the average luminance level in cd/m$^2$ of the displayed image.

It is computed as:

$$L_o=12.6\times(0.2L_\omega)^{0.63}+1.083\times10^{-5} \tag{2}$$

where $L_\omega$ is the luminance of the reference white (the minimum density area of the x-ray image (in cd/m$^2$);

2. The power function $$B=L^\rho-c, \tag{3}$$

where:

B is the perceived brightness;

ρ=0.25; and

ρ=0.25; and c is a constant that is canceled out in calculating the brightness difference. The parameter ρ can be varied from 0.2 to 0.3 with quite acceptable brightness scale;

3. Bartleson-Breneman's model- $$\log B=1.967+0.1401(\log L)-\gamma\left(\frac{L}{3.183}\right)^d \tag{4}$$

where:

$\gamma=0.99+0.318(L_\omega)^{0.25}$;

$d=-0.0521-0.0427(L_\omega)^{0.093}$;

$L_\omega$=luminance of the scene white in cd/m$^2$;

f=1.0 for light surround and 0.1 for dark surround;

L=luminance of a scene element in cd/m$^2$; and

B=brightness in subjective units of an arbitrary size.

Our preferred embodiment brightness model is the Michaelis-Menten function, as described in Equation (1).

By convention, a tone scale curve is a curve which shows film density, D, as a function of log exposure, log E. For x-ray image viewing, the luminance of an image area, L, is related to the film density by $$L=S\times10^{-D} \tag{5}$$

where S is the viewbox luminance (about 2200–3200 cd/m$^2$). If equal log exposure difference is to be reproduced as equal brightness difference, we can express their relation as:

$$B=a\log E+b \tag{6}$$

wherein E is x-ray exposure and the parameter a controls the contrast (or gamma) of the tone scale and the parameter b controls the exposure or speed of the film. From the brightness model (such as Equation (1)) and Equations (5) and (6), we can construct the ideal tone scale curve for any given contrast a and speed b.

FIG. 1 shows an example of such a visually optimized tone scale curve. As can be seen, the tone scale curve so derived has a very sharp cutoff near the minimum and the maximum densities. This could create two problems: (1) loss of details in the highlight or shadow because of the sharp truncation; and (2) sensitivity to exposure error. Gentle roll-offs in the toe and shoulder are needed to produce a more useful image. Such roll-offs can be constructed according to the following Green-Saunders equation $$D=D_{min}+\frac{D_{max}-D_{min}}{1+10^{\beta(\log E_o-\log E)}} \tag{7}$$

where:

$D_{min}$ and $D_{max}$ are the minimum and maximum density of the film; and $E_o$ is the exposure value corresponding to the half-height point of the Green-Saunders Equation (7).

Figure 2:
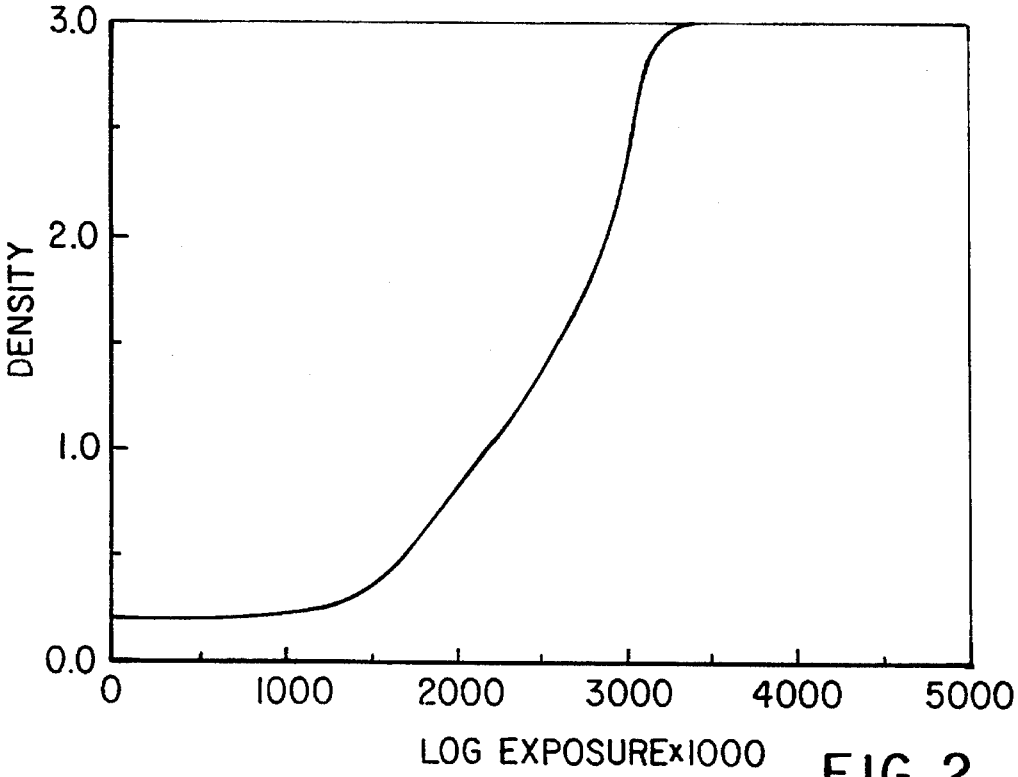
FIG. 2 shows a modified version of the tone scale curve of FIG. 1 in that the FIG. 1 tone scale curve is modified in the toe and the shoulder region according to the present invention.

We use the above function to generate the smooth toe and shoulder for a tone scale curve. FIG. 2 shows an example of such a tone scale with a smooth toe and a smooth shoulder. In order to produce a smooth tone scale curve, the junction between the visual tone scale curve and the curve of Equation 7 should be continuous up to and including the first derivative at the toe and the shoulder. This is achieved through the following calculation.

Let D=V(log E) be the visually optimized tone scale curve as determined by Equations (1), (5), and (6). Let D=A(log E) be the aim tone scale curve to be constructed from D=V(log E) by rolling off the toe and the shoulder.

Let $D_t$ be the density where D=A(log E) starts to deviate from the ideal curve, D=V(log E), at the toe, and $G_t$ be the slope at $D=D_t$.

$$G_t=\frac{dD}{d\log E}_{D=D_t}=\frac{dV}{d\log E}_{D=D_t} \tag{8}$$

Since D=V(log E) can be numerically generated from Equations (1), (5), and (6), $G_t$ can be numerically calculated as well.

Letting $y=10^{\beta}(\log E_o-\log E)$, Equation (7) can be written as $$D-D_{min}=\frac{D_{max}-D_{min}}{1+y} \tag{9}$$

Its derivative is $$\frac{dD}{d\log E}=\frac{(D_{max}-D_{min})(\ln 10)\beta y}{(1+y)^2} \tag{10}$$

Given $D=D_t$, we can solve for $y_t$ from Equation (9)

$$y_t=\frac{D_{max}-D_{min}}{D_t-D_{min}}-1 \tag{11}$$

Knowing $G_t$ and $y_t$, we can solve for β from Equation (10)

$$\beta=\frac{G_t(1+y_t)^2}{(D_{max}-D_{min})(\ln 10)y_t} \tag{12}$$

Having determined $y_t$ and β the only unknown left is $\log E_o$, which can be solved as:

$$\log E_o=\log E_t+(\log y_t)/\beta \tag{13}$$

where $\log E_t$ is the log exposure that maps to $D_t$ when D=V(log E) is generated. $D_t$ is the density at the point of transition from the optimum curve to the smooth toe portion.

Let $D_s$ be the density where D=A(log E) starts to deviate from the ideal curve, D=V(log E), at the shoulder, and $G_s$ be the slope at $D=D_s$. The above procedure can also be applied to generate a roll-off shoulder with the Green-Saunders Equation (7).

Figure 3:
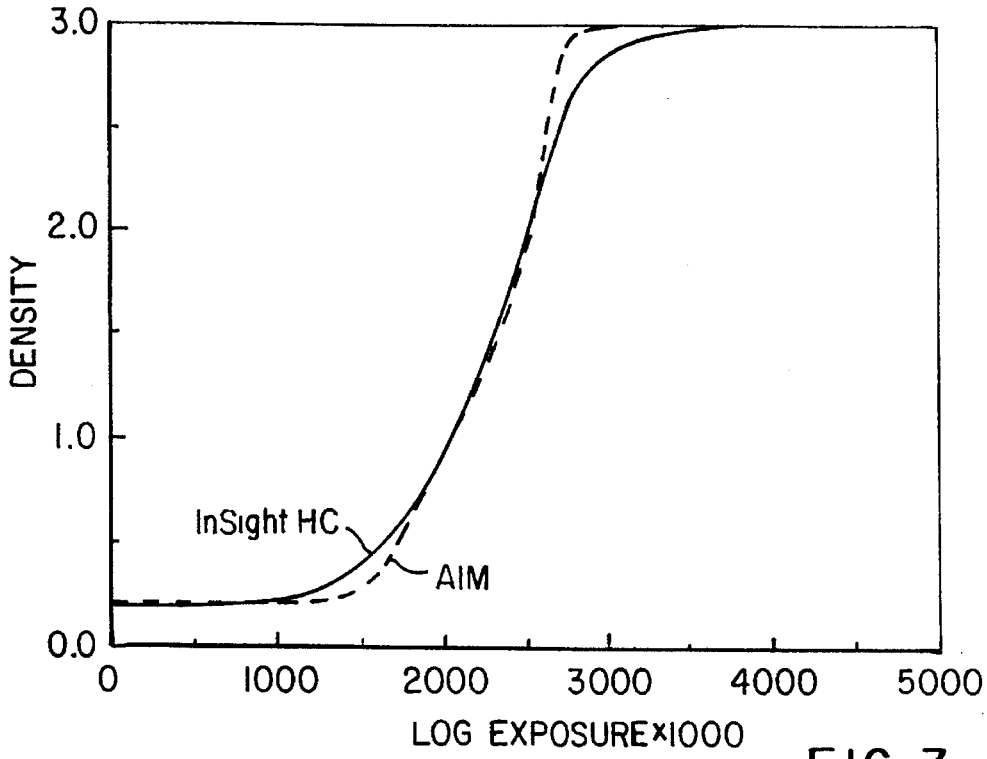
FIG. 3 shows a comparison between a tone scale curve of a typical commercial screen/film system and a visual tone scale with matched contrast and the speed of the system being compared.

The tone scale aim can be used to design various characteristic curves for conventional screen/film systems. For films to be used for chest x-rays, a medium contrast and a long toe region may be a good combination. For extremities, a high contrast, a sharp shoulder, and a sharp toe may be ideal. FIG. 3 shows an example of a tone scale aim curve generated to match the slope and exposure of the KODAK InSightHC tone scale curve at density 0.9. It can be seen that higher contrast in the highlight and the shadow is desirable for the current screen/film systems.

Digital radiography using storage phosphors offers a very wide exposure latitude ($10^4$:1) compared with that of the conventional screen/film systems. With proper image enhancement by computers, the image quality of digital radiography is roughly comparable to that of film/screen.

Given the wide exposure latitude of a storage phosphor system, a digital x-ray image usually captures all the clinically important information and can be printed on a x-ray film through an arbitrary tone scale look-up table. Since film has a limited dynamic range and since many images require high contrast for proper diagnosis, it is desirable to be able to trade off dynamic range with contrast or vice versa on an image by image basis. The visually optimized tone scale we have described above has four parameters that can be adjusted either automatically or manually for each image to achieve its best diagnostic quality. Two of the four parameters, are used in Equation (6): B=a log E+b and the other two are used to set the toe and shoulder densities:

a) contrast a: a=0.60 will produce a gamma of 1.5 at density 0.9, similar to the mid-tone contrast for KODAK InSightHC system;

b) speed: a good approximation is to set the exposure so that the darkest part of region of interest is printed at a density of 2.3;

c) toe density $D_t$-Density below $D_t$ is in the toe region of the tone scale, where the contrast is reduced and the density is increased. For chest x-ray images, the abdomen is usually in the toe region. Therefore, we may want to raise the toe density. In general, setting $D_t$ to 0.25 above $D_{min}$, is a good starting point; and d) shoulder density $D_S$: density above $D_S$ is in the shoulder region of the tone scale, where both the contrast and the density are reduced from the ideal curve D=V(log E). In general, setting $D_S$ to 0.5 below $D_{max}$, is a good starting point.

Figure 4:
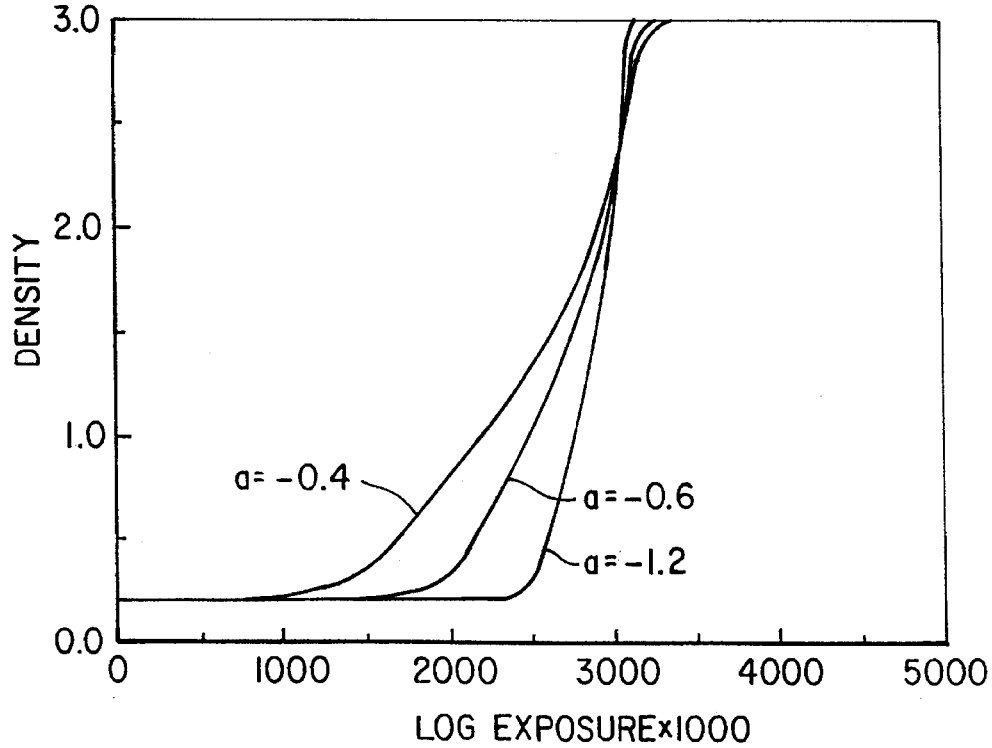
FIG. 4 shows three separate tone scale curves according to the invention which have differing contrast parameters.
Figure 5:
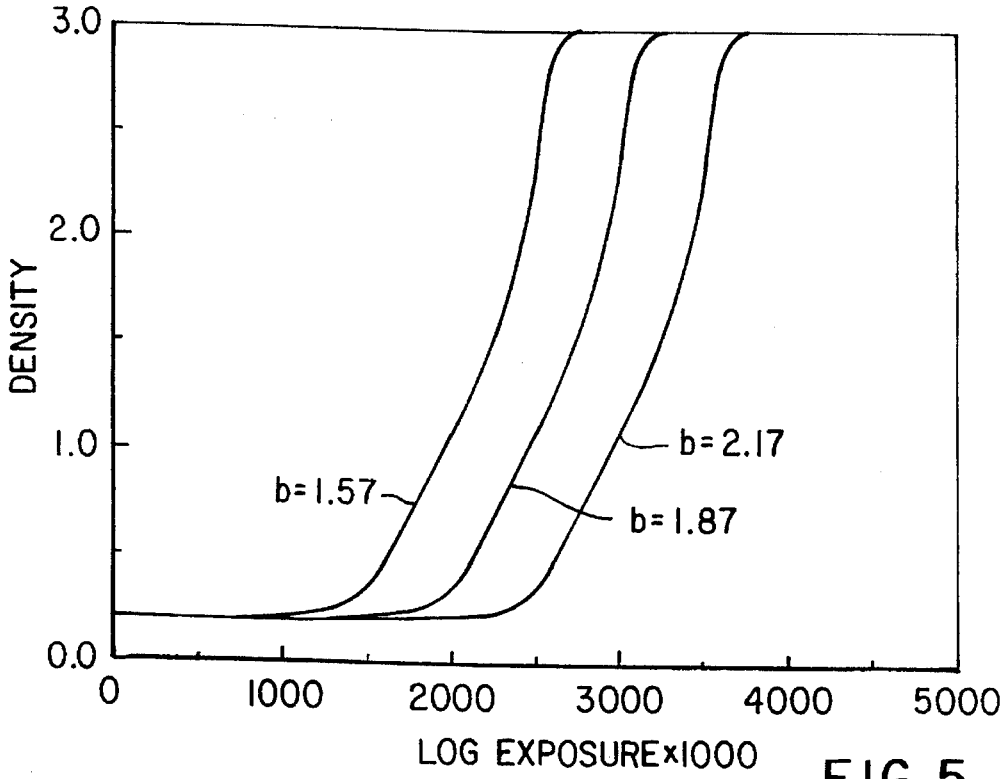
FIG. 5 shows three separate tone scale curves according to the invention which have differing speed parameters.
Figure 6:
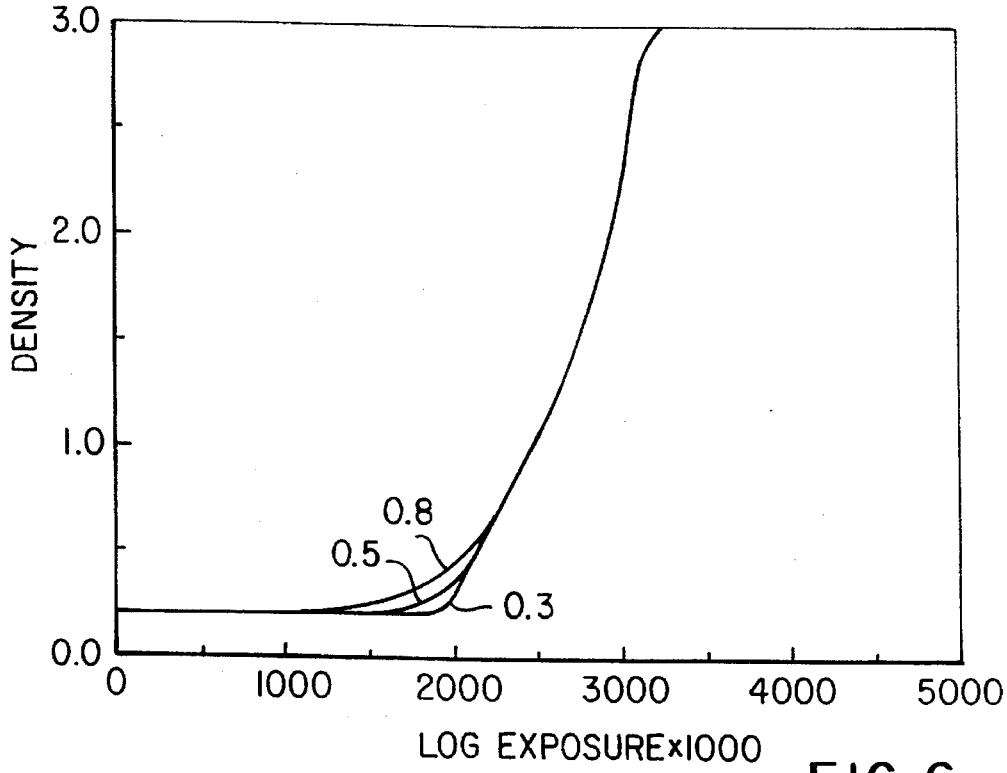
FIG. 6 shows three different toe parameters for a particular tone scale curve.
Figure 7:
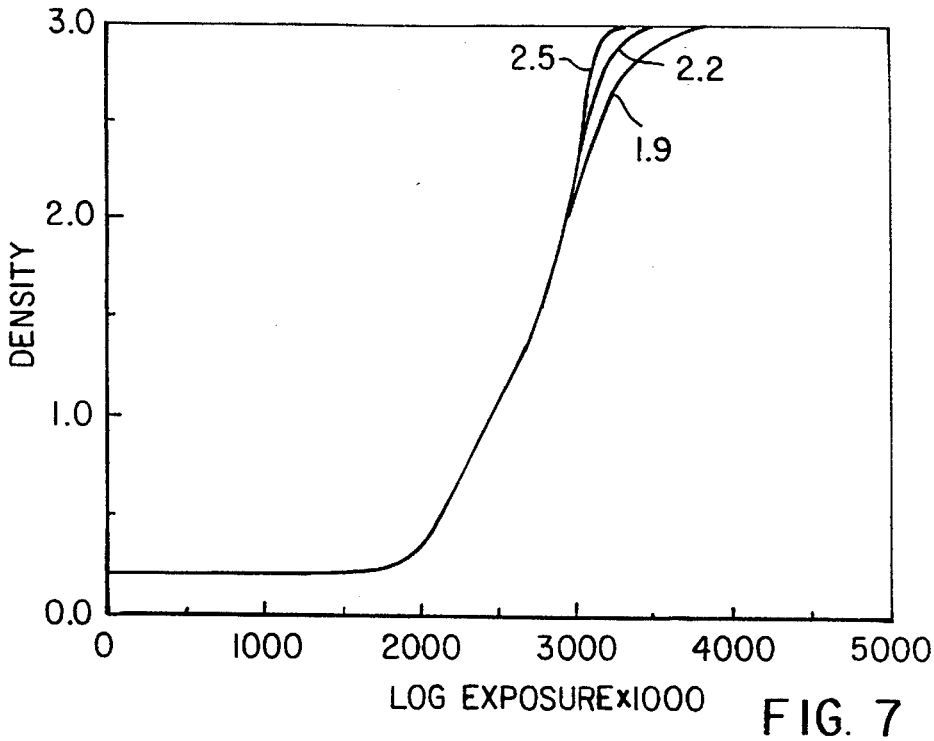
FIG. 7 shows three different shoulder parameters for a particular tone scale curve.

The effects of changing these four parameters are shown in the following four figures. FIG. 4 shows the effect of changing the contrast parameter a. FIG. 5 shows the effect of changing the exposure parameter b. FIG. 6 shows the effect of changing the toe parameter $D_t$. FIG. 7 shows the effect of changing the shoulder parameter $D_S$. An automatic contrast and exposure determination algorithm can be implemented to adjust these four parameters on an image by image basis. The advantage of having a complete functional description of the visually optimized tone scale is that the optimal curve can be customized for each individual image by a computer.

Figure 8:
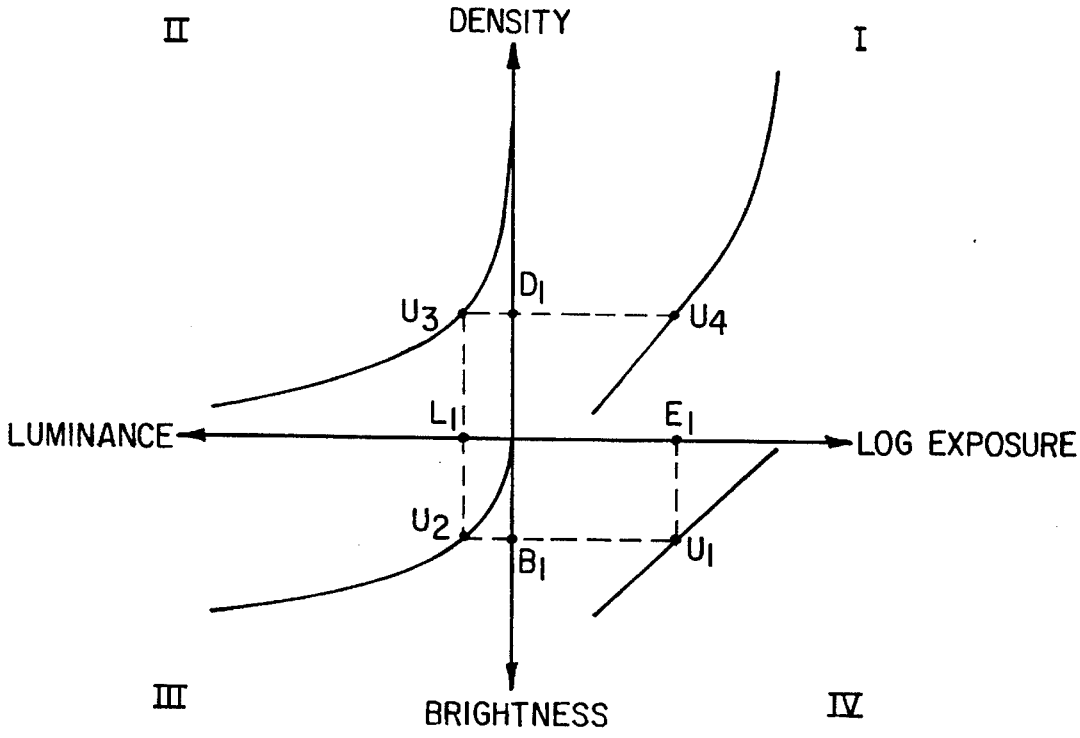
FIG. 8 shows a graphical method for constructing a tone scale curve using brightness, luminance, density, and log exposure.

Turning now to FIG. 8 which a graphical method is shown for constructing a tone scale curve in accordance with the present invention. As shown, a brightness curve (B) is plotted as a straight line with reference to brightness and log exposure axis. Next the brightness as a function of luminance is selected in accordance with the Michaelis-Menten function. Then the relationship between luminance and density is plotted. This relationship can be in accordance with Equation (5).

After the relationships are plotted, then the tone scale curve, which is a relationship of density versus log exposure, can be graphically constructed as in FIG. 8. For example, a given exposure $E_1$ defines a point $U_1$ on the brightness versus log exposure curve, which in turn defines a brightness point $B_1$. Point $B_1$ defines point $U_2$ on the luminance versus brightness curve. This in turn defines a luminance point $L_1$. Point $L_1$ then defines point $U_3$ on the luminance versus density curve. Point $U_3$ defines a density point $D_1$. Given density point $D_1$ at exposure point $E_1$, a point $U_4$ is completely defined on the tone scale curve. In a similar fashion, the other points on the tone scale curve can be constructed.

Figure 9:
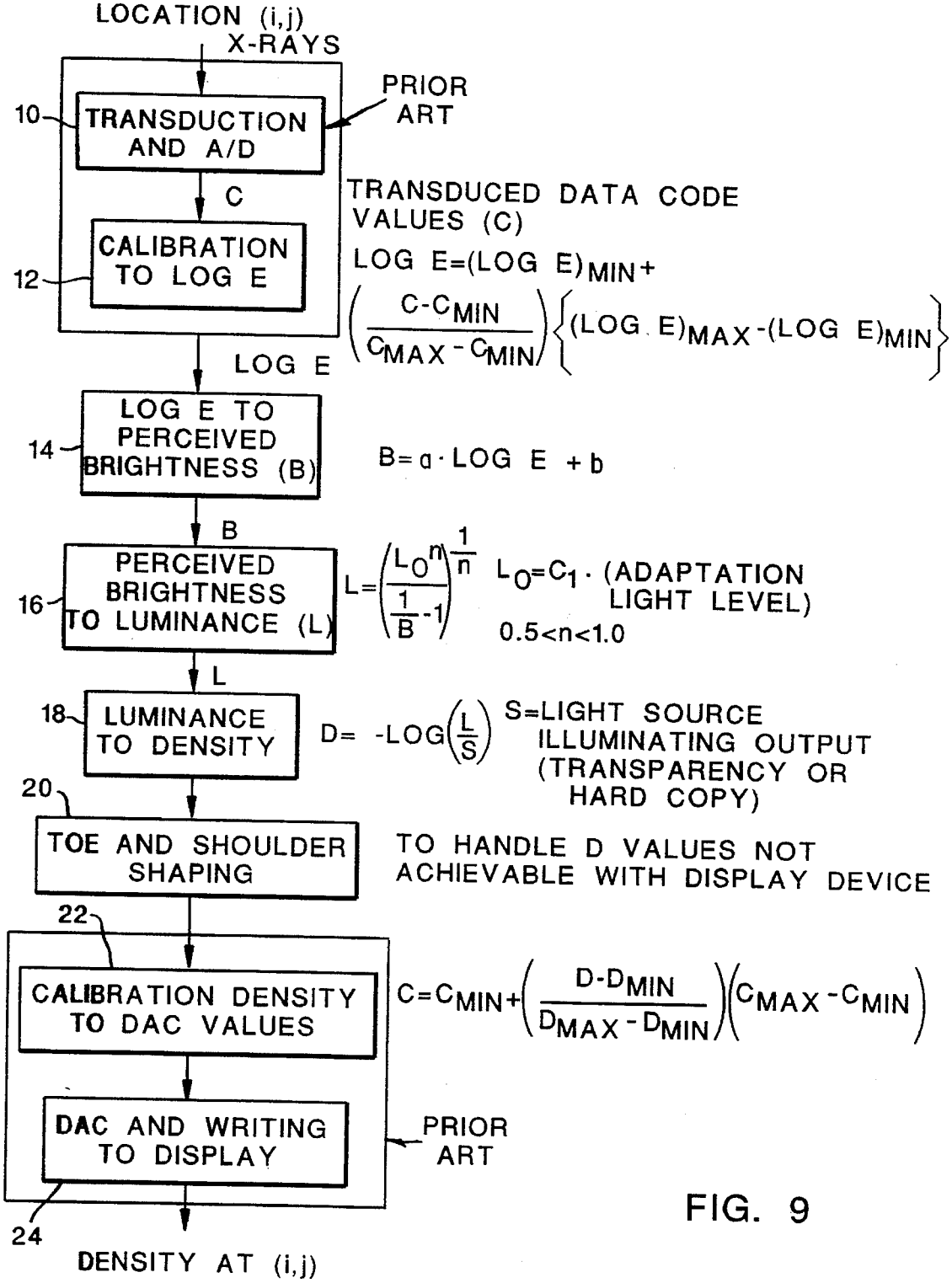
FIG. 9 shows a schematic representation of a method by which the invention is implemented to process an image.

Turning now to FIG. 9 which shows in block diagram form, an electrical system for receiving an analog image signal and for converting such image signal into a output signal which can be shown on a display. In this conversion process a tone scale curve in accordance with the present invention is employed. In FIG. 9 an analog image such as produced by computed radiography is provided as a input to an analog to digital converter 10. Since the input image signal may not be directly proportional to log exposure, it should be calibrated as shown in block 12. For example, code values provided by the A-D convert 10, may be linearly related to log exposure over a limited known range. This linear relationship or calibration is actually provided in block 12 so that the output of block 12 is log E. In this case, Equation (14) is used to compute the value of log exposure corresponding to a given code value. Other known functional relationships between code value and log exposure could be accommodated using the relationship:

$$\log E = (\log E)_{min} + \left( \frac{C - C_{min}}{C_{max} - C_{min}} \right) \{(\log E)_{max} - (\log E)_{min}\} \quad (14)$$

wherein C is provided by the A-D converter 10, cmin and cmax are respectfully the minimum and maximum code values which can be produced by the A-D converter 10. (Log $E)_{min}$ and (log $E)_{max}$ are respsectfully the corresponding log exposure values corresponding to $C_{min}$ and $C_{max}$ respectfully.

Next in the process, the calibrated log exposure signal is convened to brightness (B) (block 14). This can, of course, be done in accordance with Equation (6). Next, luminance is calculated in accordance with Equation (1) which is manipulated to have the form shown in FIG. 9.

The next step, 18, is to convert luminance to density in accordance with Equation (5). Toe and shoulder smoothing may be accomplished as previously described in step 20. The resulting density values are converted into the code values needed by a calibrated printer as shown in step 22. For example, if the printer produces density that is linearly related to code value between some minimum density and maximum density, then Equation (15) is used to compute the required code values. Finally, step 24 represents the printing process whereby the code value is used to produce the desired density on the output film at each pixel.

$$C = C_{min} + \left( \frac{D - D_{min}}{D_{max} - D_{min}} \right) (C_{max} - C_{min}) \quad (15)$$

The present invention can also be used in processing input signals in accordance with a tone scale curve so that equal log exposure differences in an x-ray image of an object produce substantially equal brightness differences in a displayed image so that objects of interest, such as tumors, can be better distinguished at all densities. This will be clearly understood to one skilled in the art and can be accomplished in accordance with the following steps. Equation 6 can be used to calculate the brightness of a calibrated log exposure signal. Next, equation 1 can be used to calculate the luminance L. Of course, equation 1 can be rearranged to solve for L. Then, the density can be computed in accordance with equation 5. The inverse of equation 5 will have to be taken to solve for density. Finally, for each pixel the calculated density will be outputted.

It is an important feature of the present invention that it can be readily adapted for input digital pixels. Assume, for example, that the log exposure of a pixel can be described by twelve bits. In other words there will be 4096 different log exposure levels. The necessary data transformation for each one can be calculated and placed within the memory of a digital processing machine such as a computer. In fact, it can be placed in a look-up table and the look-up table can respond to input signals and readily provide the output density.

Figure 10:
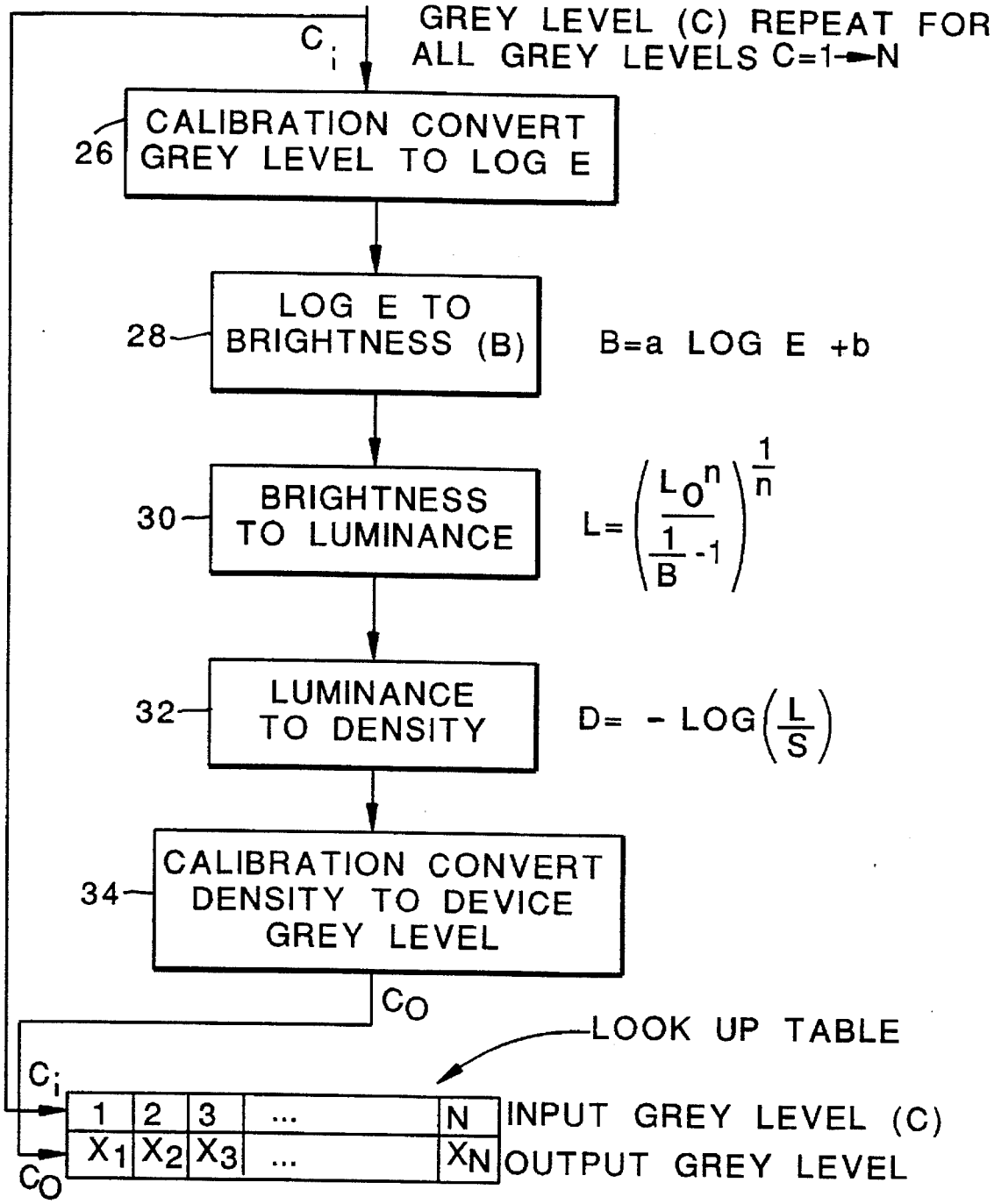
FIG. 10 show a schematic representation of a method by which a look-up table is generated to implement the invention as shown in FIG. 11.
Figure 11:
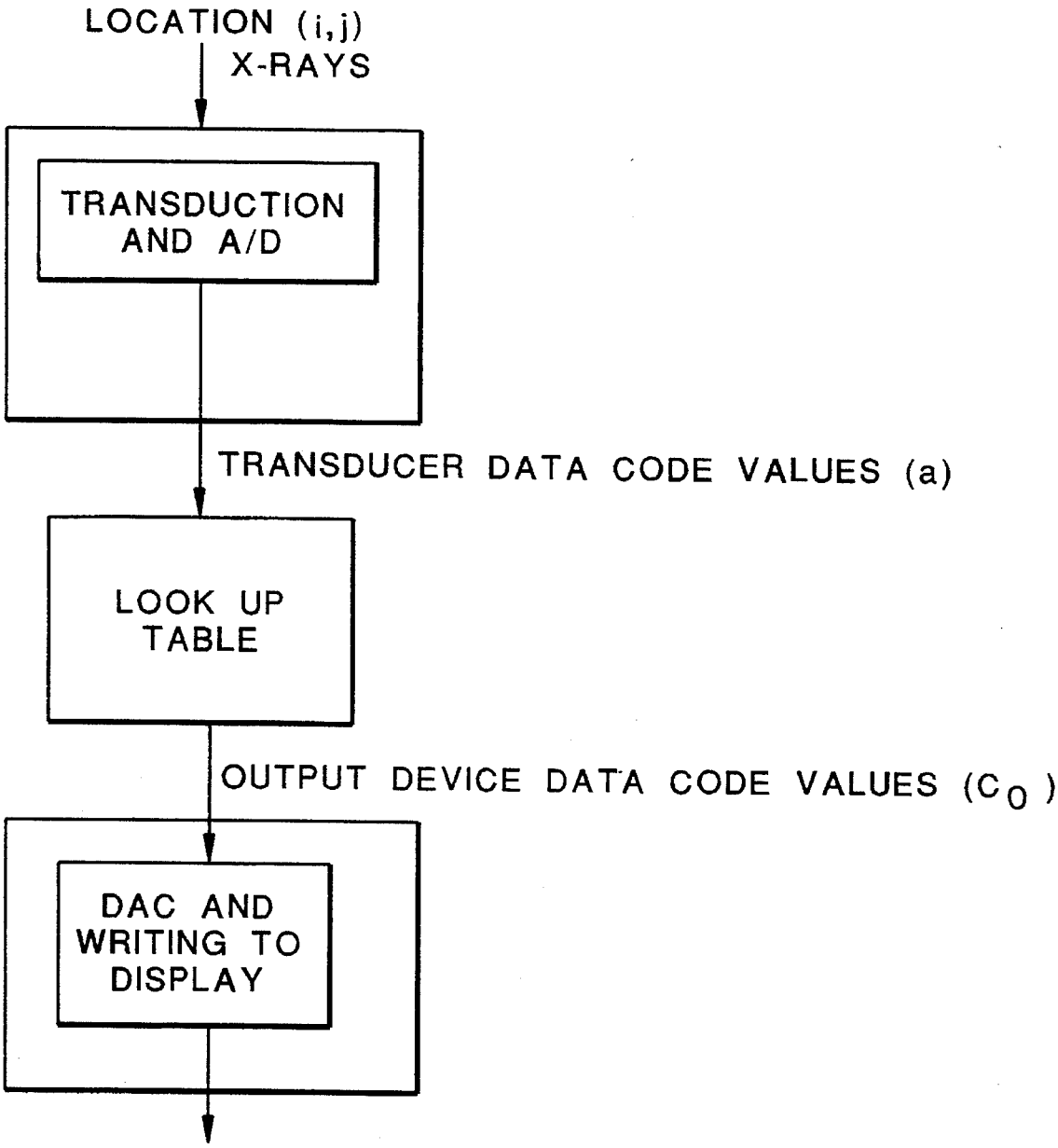
FIG. 11 shows a schematic representation of a method by which the invention is implemented to process an image using the look-up table generated as shown in FIG. 10.

FIG. 10 shows a flow chart which can be used to implement the process of FIG. 9 by constructing look-up tables. In this process a calibration step 26 corresponds somewhat to calibration step 12 in FIG. 9. Step 28 corresponds to step 14. Step 30 corresponds to step 16. Step 32 corresponds to step 18 and step 34 corresponds to step 22. It will be understood that toe and shoulder can also be used in accordance with this procedure. Although not shown, toe and shoulder techniques can also be used. As shown, for all the code values of interest, a look-up table will have an input code value $C_i$ and an output code value $C_o$. Now, with this process, as shown in FIG. 11, for any given image which will use the same look-up table, the output of transducer will be provided into the look-up table and the look-up table will in turn produce an output code value. An advantage of this arrangement is, of course, that once the look-up table is constructed, it can rapidly process any image without having to go through repetitive calculations.

The following is a description of an example used to coat emulsions which can be used in film or film screens in accordance with the present invention.

The following description is based on a 1 liter initial volume.

Process for making a first Emulsion A

In a reaction vessel was placed an aqueous gelatin solution (composed of 1 liter of water, 2.5 g of oxidized alkali-processed gelatin, 3.7 ml of 4N nitric acid, 0.6267 g of sodium bromide, and 4.4%, based on the total weight of silver introduced during nucleation, of PLURONIC-31R1 made by BASF as surfactant) and while keeping the temperature thereof at 45 C., 13.3 ml of an aqueous solution of silver nitrate (containing 7.25 g of silver nitrate) and equal amount of an aqueous halide solution (containing 4.47 g of sodium bromide and 0.007 g of potassium iodide) were simultaneously added into the vessel over a period of 1 minute at a constant rate. Immediately after, into the vessel was added 4.67 ml of an aqueous halide solution (containing 1.57 g of sodium bromide and 0.0026 g potassium iodide) over 1.4 minutes at constant rate. Temperature of the vessel was raised to 60 C. over a period of 9 minutes. At that time, 46.5 ml of an ammonium solution (containing 3.37 g of ammonium sulfate and 29.8 ml of 2.5N sodium hydroxide solution) was added into the vessel and mixing was conducted for a period of 9 minutes. Then, 261.5 ml of an aqueous gelatin solution (containing 16.7 g of oxidized alkali-processed gelatin, 11.5 ml of 4N nitric acid solution, and 0.085 g of PLURONIC-31R1 made by BASF) was added to the mixture over a period of 6 minutes. Subsequently, 16.7 ml of an aqueous silver nitrate solution (containing 9.06 g of silver nitrate) and 16.8 ml of an aqueous halide solution (containing 5.65 g of sodium bromide and 0.009 g of potassium iodide) were added at constant rate over a period of 10 minutes. pAg of the vessel was then shifted to 8.68 with appropriate amount of silver nitrate solution over a period of 2.5 minutes Then, 226.2 ml of an aqueous silver nitrate solution (containing 122.3 g of silver nitrate) and 224.5 ml of an aqueous halide solution (containing 75.3 g of sodium bromide and 0.12 g of potassium iodide) were added at a constant ramp over a period of 51.8 minutes starting from 1.67 ml/min. The silver halide emulsion thus made was washed and was characterized as 0.62 um in average diameter, 0.121 um in average thickness, and COV=14.0%.

Process for a second Emulsion B

In a reaction vessel was placed an aqueous gelatin solution (composed of 1 liter of water, 1.68 g of oxidized alkali-processed gelatin, 3.5 ml of 4N nitric acid, 0.6267 g of sodium bromide, and 6.5%, based on the total weight of silver introduced during nucleation, of PLURONIC-31R1 made by BASF as surfactant) and while keeping the temperature thereof at 45 C., 11.2 ml of an aqueous solution of silver nitrate (containing 2.47 g of silver nitrate) and 11.2 ml of an aqueous halide solution (containing 1.54 g of sodium bromide) were simultaneously added into the vessel over a period of 1 minute at a constant rate. Thereafter, the vessel was added 19.2 ml of an aqueous halide solution (containing 1.97 g of sodium bromide) after 1 minute of mixing. Temperature of the vessel was raised to 60 C. over a period of 9 minutes. At that time, 43.3 ml of an ammonium solution (containing 3.37 g of ammonium sulfate and 26.7 ml of 2.5N sodium hydroxide solution) was added into the vessel and mixing was conducted for a period of 9 minutes. Then, 252.2 ml of an aqueous gelatin solution (containing 16.7 g of oxidized alkali-processed gelatin, 11.3 ml of 4N nitric acid solution, and 0.113 g of PLURONIC-31R1 made by BASF) was added to the mixture over a period of 2 minutes. Subsequently, 7.5 ml of an aqueous silver nitrate solution (containing 1.66 g of silver nitrate) and an equal volume of an aqueous halide solution (containing 1.03 g of sodium bromide) were added at constant rate over a period of 5 minutes. Then, 474.8 ml of an aqueous silver nitrate solution (containing 129.0 g of silver nitrate) and 467.8 ml of an aqueous halide solution (containing 80.8 g of sodium bromide) were added at a constant ramp over a period of 64 minutes starting respectively from 1.5 ml/min and 1.53 ml/min. Thereafter, 253.3 ml of an aqueous silver nitrate solution (containing 68.9 g of silver nitrate) and 249.0 ml of a halide solution (containing 43.0 g of sodium bromide) were added a constant rate over a period of 19 minutes. The silver halide emulsion thus made was washed and was characterized as 1.15 um in average diameter, 0.115 um in average thickness, and COV=8.3%.

Sensitization

Emulsion A and B thus made were optimally sensitized as follows (per silver mole): at 40 C., it was added with 4.1 mg potassium tetrachloroaurate, 176 mg sodium thiocyanate, 500 mg green sensitive dye, benzoxazolium, 5-chloro-2-(2-((5-chloro-3-(3-sulfopropyl)-2(3H)-benzoxazolylidene)methyl)-1-butenyl)-3-(3-sulfopropyl)-N,N-diethylethanamine, 20 mg anhydro-5,6-dimethyl-3(3-sulfopropyl)benzothiozolium, 4.1 mg sodium thiosulfate*petahydrate, 0.45 mg potassium selenocyanate, heat ramped to 65 C. at 5 C./3 min, held for 18 minutes, chilled down to 40 C., 300 mg potassium iodide, and 2.2 g 5-methyl-s-triazole-(2-3-a)-pyrimidine-7-ol.

Coating 400 mg/ft$^2$ of Emulsion A and 80 mg/ft$^2$ of Emulsion B were coated along with 547 mg/ft$^2$ of gelatin, and 2.5% ethene, 1,1'-(oxybis)methylenesulfonyl))bis-, a hardener, on polyester support.

Exposure and processing

The coating was subjected to a sensitometer of 2850 K color temperature with green filter and a 21 step tablet (0.2 log E increment) for 1/50 sec and processed at 20 C. in a commercially available KRX processing solution for 12 minutes.

D log E curve

Figure 12:
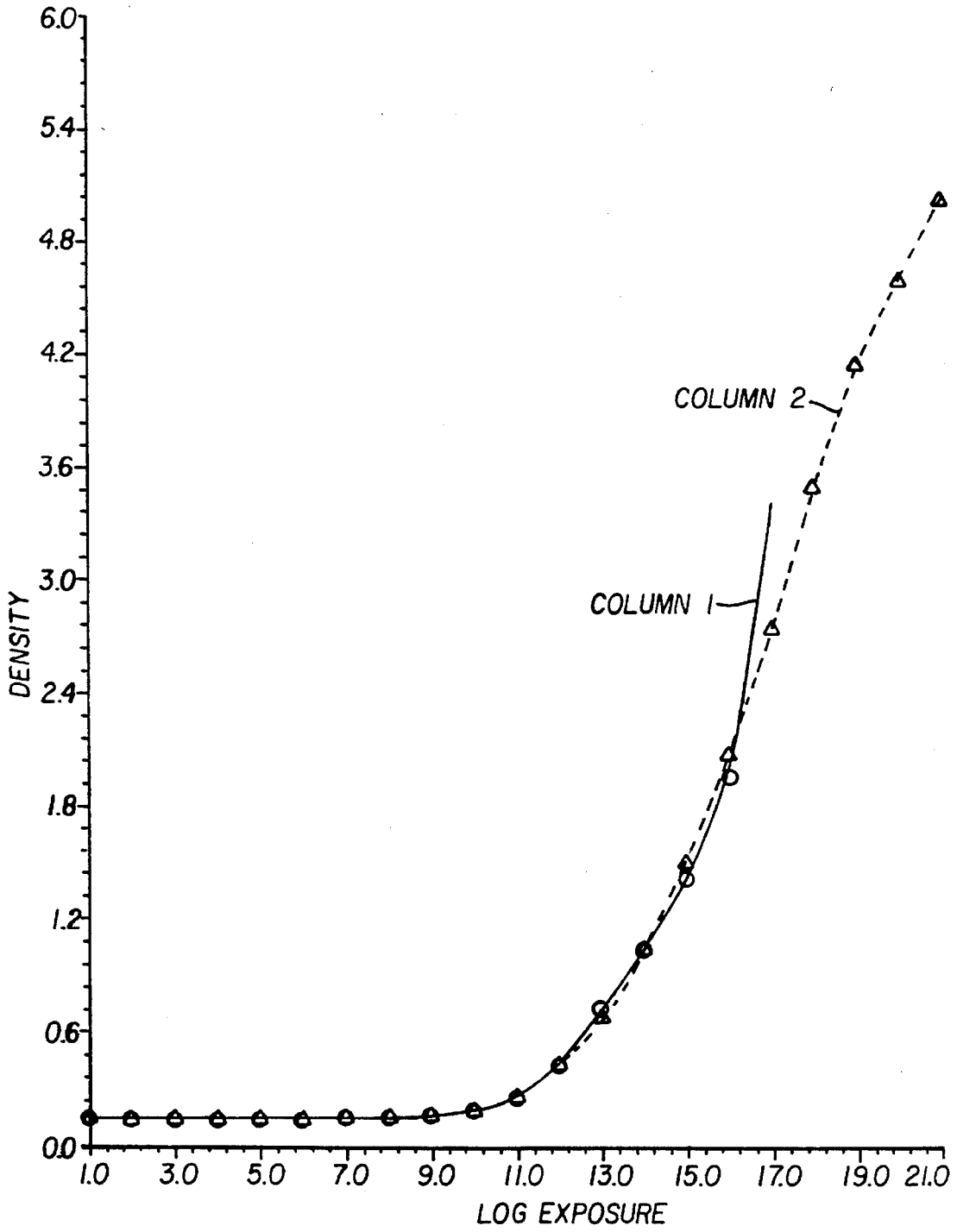
FIG. 12 shows a density versus log exposure for an emulsion coating actually constructed in accordance with the present invention.

The optical density of the coating thus obtained was plotted along with the simulation in FIG. 12 with matched Dmin.

The invention has been described in detail with particular reference to certain preferred embodiments thereof, but it will be understood that variations and modifications can be effected within the spirit and scope of the invention.

| PARTS LIST | |
|---|---|
| 10 | digital converter |
| 12 | a–d conversion |
| 14 | calculate brightness |
| 16 | calculate luminance |
| 18 | luminance to density |
| 20 | toe and shoulder shaping |
| 22 | calibration density to DAC values |
| 24 | DAC and writing to display |
| 26 | calibration conversion |
| 28 | logE to brightness |
| 30 | brightness to luminance |
| 32 | luminance to density |
| 34 | calibration to gray level |

We claim:

1. A method of constructing a tone scale curve so that equal log exposure differences in an x-ray image of an object produce substantially equal brightness differences in a displayed image so that objects of interest, such as tumors, can be better distinguished at all densities, comprising the steps of:

a) selecting a brightness versus log exposure relationship;

b) developing a luminance versus brightness curve based substantially on the equation $$B=\frac{L^n}{L^n+L_o^n}$$

where:

B is the perceived brightness;

n is in the range of $0.5<n<1.0$;

$L_o=12.6\times(0.2\times L_\omega)^{0.63}+1.083\times10^{-5}$;

L is the luminance in cd/m$^2$;

$L_\omega$ is the luminance of the minimum density area of the x-ray film; and c) using a density versus luminance curve and thereby producing the tone scale curve in which density is a function of log exposure, such that equal log exposure differences in an x-ray image of an object produce substantially equal brightness differences in the displayed image.

2. The method of claim 1 wherein the tone scale constructing method is accomplished either by digital or analog techniques.

3. The method of claim 2 wherein the brightness versus log exposure is a straight line curve.

4. The method of claim 2 wherein the luminance versus brightness curve based upon a power function or the Bartleson-Breneman's model.

5. The method of claim 2 further including the step of generating a smooth toe and a smooth shoulder for the tone scale curve so that the first derivative of such curve is substantially continuous.

6. The method of claim 2 wherein a family of visually optimized tone scale curves is specified by four parameters: exposure, contrast, toe density, and shoulder density.

7. A method of constructing a film or a film-screen combination providing a tone scale curve wherein equal log exposure differences in an x-ray image of an object produce substantially equal brightness differences in a displayed image so that objects of interest, such as tumors, can be better distinguished, comprising the steps of:

a) constructing a tone scale curve by i) selecting a linear brightness versus log exposure relationship;

ii) developing a luminance versus brightness curve based substantially on the equation $$B=\frac{L^n}{L^n+L_o^n}$$

where:

n is in the range of $0.5<n<1.0$;

$L_o=12.6\times(0.2\times L_\omega)^{0.63}+1.083\times10^{-5}$;

L is the luminance in $cd/m^2$; and $L_\omega$ is the luminance in $cd/m^2$ of the minimum density area of the x-ray film;

iii) selecting a density versus luminance curve and thereby producing the tone scale curve which is a function of the density versus log exposure curve, such that equal log exposure differences in an x-ray image of an object produce substantially equal brightness differences in the displayed image of the x-ray image; and b) producing the film based upon such tone scale curve.

8. A film or a film-screen combination providing a tone scale curve wherein equal log exposure differences in an x-ray image of an object reproduces substantially equal brightness differences in a displayed image of the x-ray image so that objects of interest, such as tumors, can be distinguished, comprising:

a) a substrate; and b) one or more emulsion layer having ingredients selected in accordance with the tone scale curve.

* * * * *